United States Patent [19]

Judy et al.

[11] Patent Number: 4,629,171

[45] Date of Patent: Dec. 16, 1986

[54] PORTABLE JIG FOR ASSEMBLING PREFABRICATED BUILDING STRUCTURES

[75] Inventors: Robert H. Judy, Clearwater, Fla.; Herman L. Judy, Alexandria, Va.

[73] Assignee: E. I. Du Pont de Nemours and Company, Wilmington, Del.

[21] Appl. No.: 847,146

[22] Filed: Apr. 2, 1986

Related U.S. Application Data

[63] Continuation of Ser. No. 726,529, Aug. 5, 1985, abandoned.

[51] Int. Cl.[4] ..... B25B 11/02

[52] U.S. Cl. ..... 269/37; 269/207; 269/910

[58] Field of Search ..... 269/37, 41, 108, 130, 269/132, 156, 165, 188, 207, 216, 910

[56] References Cited

U.S. PATENT DOCUMENTS

| | | | |
|---|---|---|---|
| 2,368,843 | 2/1945 | Kees | 269/207 X |
| 2,626,643 | 1/1953 | Kantzler | 269/41 |
| 3,299,920 | 1/1967 | Koenigshof | 269/910 X |
| 3,945,630 | 3/1976 | Brunemann | 269/910 X |
| 4,154,436 | 5/1979 | Sellers | 269/910 X |

*Primary Examiner*—Frederick R. Schmidt
*Assistant Examiner*—Steven P. Schad

[57] ABSTRACT

A jig for assembling a prefabricated building wall or similar structure including a supporting frame formed of first and second pairs of supporting members disposed in a generally polygonal configuration, at least two pair of clamping members, each pair of clamping members including opposing first and second clamping members between which are supported first parallel structural members, such as a header and sill plate and a plurality of joist therebetween, at least one of the clamping members of each pair having a rod received in a sleeve with a cooperative pin and a plurality of cam slots effect stepwise adjustment thereof, the same clamping member of each pair also including a threaded rod for fine adjustment, and a flexible cable interconnecting the clamping members of each pair to augment the clamping force provided by each pair of clamping members adjacent to nailing the structural members together to form the prefabricated building wall.

20 Claims, 17 Drawing Figures

FIG.3
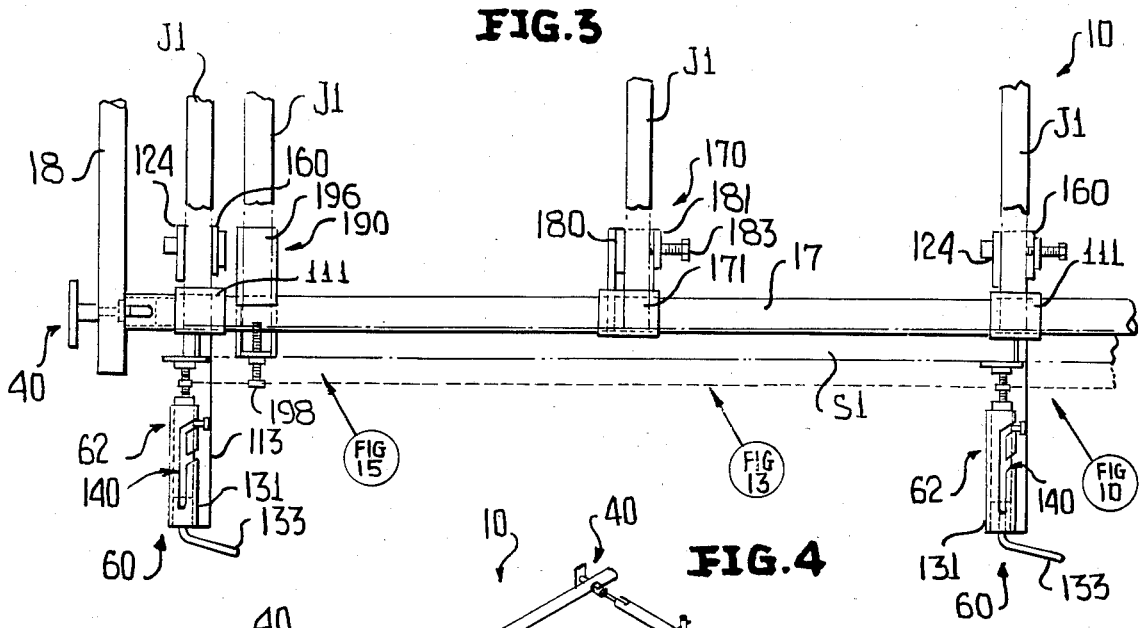
FIG.4
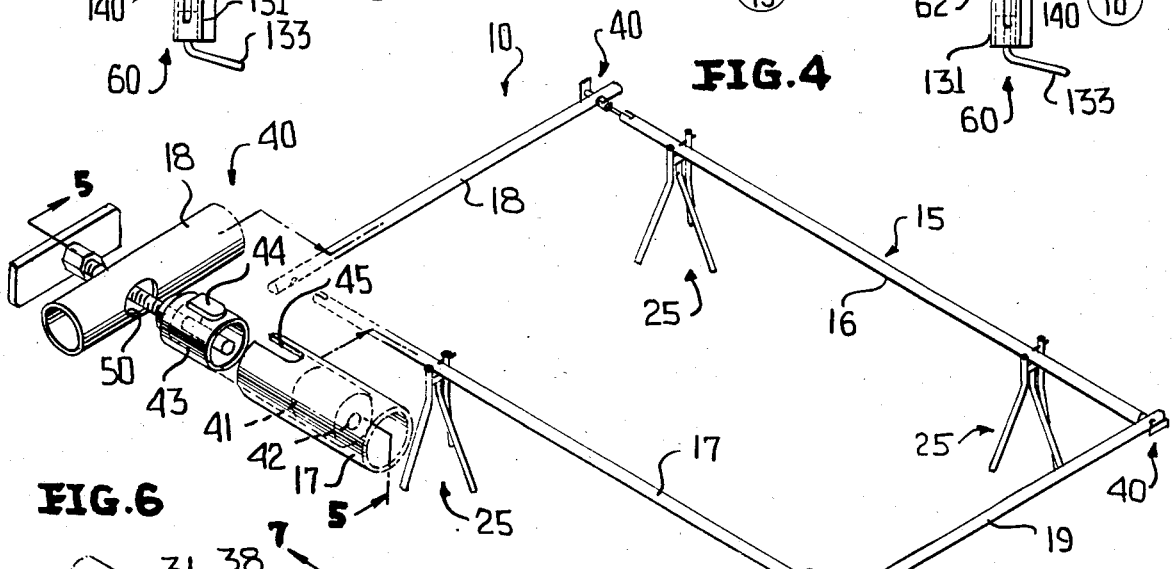
FIG.6
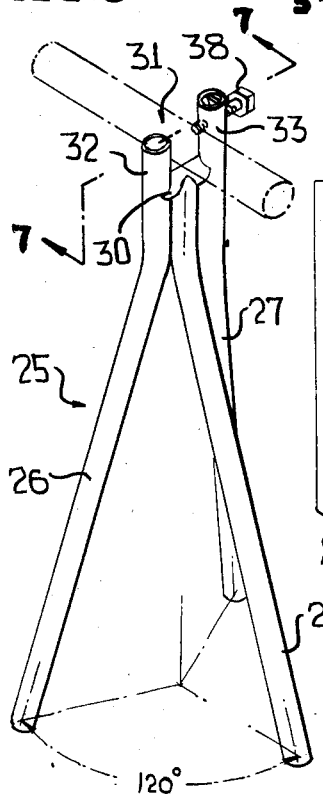
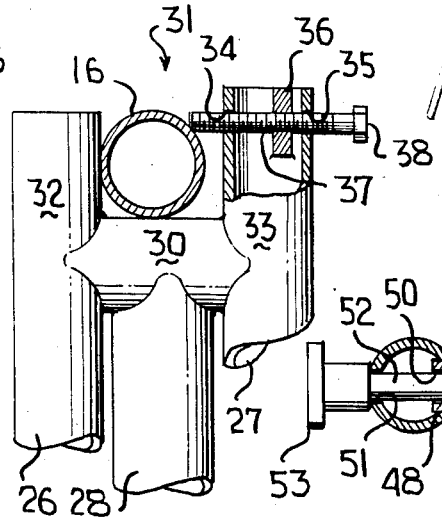
FIG.7
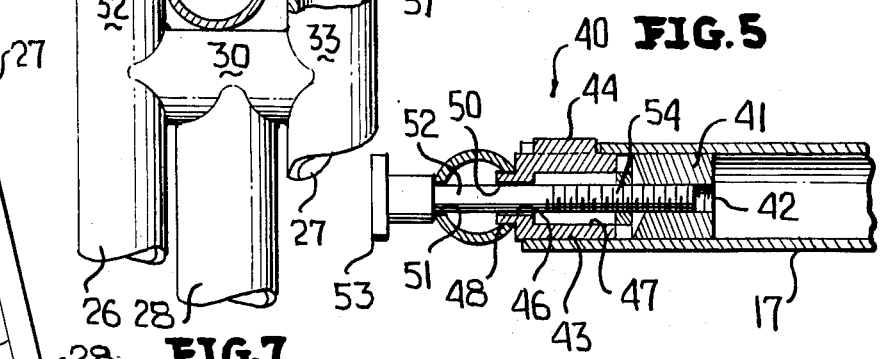
FIG.5

PORTABLE JIG FOR ASSEMBLING PREFABRICATED BUILDING STRUCTURES

This application is a continuation of application Ser. No. 06/726,529, filed Aug. 5, 1985, now abandoned.

The present invention is directed to a novel jig for assembling a prefabricated building wall, floor or similar structure formed from a plurality of structural members, such as wooden 2×4's and/or 2×6's, etc. When forming a prefabricated building wall from wooden 2×4's, it is conventional to place the sill plate (or double sill plates) in parallel relationship to the header with studs therebetween. These are then nailed together, generally with appropriate firestopping, bracing, and the usual cripple studs/jack studs and sills/headers for windows and doors. Obviously, any such wall (or floor) must be "square" or true, and whether it is being nailed together by manual or power tools, this prevents a difficult task, particularly if performed by but a single person. In the latter case it is simply difficult to nail together a wall in an economical period of time, and while time may be lessened as manpower is increased, so too is the cost.

Accordingly, it is a primary object of the present invention to provide a novel jig for assembling prefabricated building walls, floors or similar structures in a relatively short period of time with attendant ease, accuracy and low economic outlay.

Another object of this invention is to provide a novel jig as aforesaid, wherein the jig includes a supporting frame formed of first and second pairs of supporting members or tubes arranged in a generally polygonal configuration, the supporting frame being adapted to support thereupon sills, headers, studs, etc. in a conventional manner, two pair of relatively spaced clamping members each adapted to abutingly engage an associated sill or header, and means for forcefully urging the clamping members relative toward each other thereby bringing the sill or sole plate and header into intimate engagement with the ends of the studs to permit the same to be manually or automatically nailed together to form the prefabricated building wall.

Another object of this invention is to provide a novel jig in the manner set forth heretofore wherein the clamping members are moved toward each other by manually operable reciprocal rods.

Still another object of this invention is to provide a novel jig in the manner set forth heretofore including means for threadably adjusting an abutment plate of each clamping member relative to its associated rod to accommodate for variations in lumber and/or the size of the buiding wall which is to be assembled.

Still another object of this invention is to provide a novel jig of the type set forth heretofore including means spanning associated clamping members for placing the same under tension to thereby augment the clamping force between the clamping members during the nailing operation.

Yet another object of this invention is to provide a novel jig in the manner heretofore set forth including means for assembling the supporting tubes in a knock-down fashion, means providing a plurality of bases for supporting the overall supporting frame at a comfortable working height, and a plurality of individual means for supporting the ends of studs, as necessary, along the supporting frame.

With the above, and other objects in view that will hereinafter appear, the nature of the invention will be more clearly understood by reference to the following detailed description, the appended claims and the several views illustrated in the accompanyng drawings.

IN THE DRAWINGS

FIG. 1 is a top plan view of a novel jig constructed in accordance with this invention, and illustrates supporting tubes arranged in a polygonal configuration supporting thereupon a header, a sill or sole plate, and a plurality of studs and/or jack studs and cripple studs therebetween, and opposing pairs of clamping members for forcing the header and sole plate toward each other to intimately clamp the studs therebetween for subsequent nailing.

FIG. 3 is an enlarged top plan view of the encircled portion of FIG. 1, and illustrates the corresponding opposite pair of clamping members, the reciprocal rods and abutment plates thereof, and a two-step cam adjustment for the rods and associated abutting plates of the clamping members to adapt the jig for forming building walls having single or double sole plates or sills.

FIG. 4 is a top perspective view of a supporting frame of a jig, and illustrates a plurality of bases or stands therefor, and an enlarged fragmentary perspective view of a coupling at a corner of the frame.

FIG. 5 is a cross-sectional view taken generally along line 5—5 of FIG. 4 after the coupling has been assembled, and illustrates the components thereof.

FIG. 6 is a perspective view of the stand illustrated in FIG. 2, and illustrates the manner in which three legs thereof cooperate to form a yoke for the associated supporting tube.

FIG. 7 is an enlarged fragmentary sectional view taken generally along line 7—7 of FIG. 6, and illustrates a threaded bolt for removing the stand relative to the supporting tube.

Figure 17:
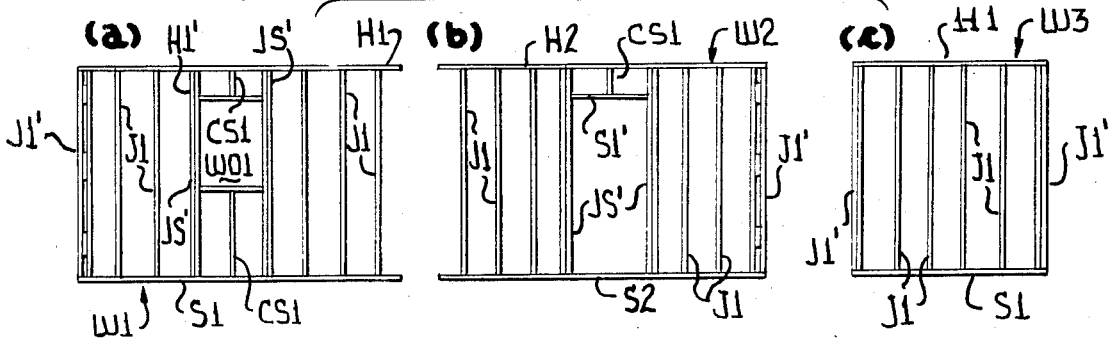

FIG. 17(*a*) through (*c*) is a side elevational view, and illustrates several different prefabricated building walls which can be formed upon the jig of the present invention.

Reference is first made to FIGS. 17(*a*) through 17(*c*) and three prefabricated building walls or similar structures which have been generally designated by the reference characters W1, W2 and W3. The walls or building structures W1, W2 and W3 can be either exterior or interior walls and/or partitions of buildings, and normally are simply constructed from wooden 2×4's which are nailed together manually or with pneumatic nailers and/or staplers.

The wall W1 is formed from a first plurality of structural members H1, S1 in generally spaced parallel relationship. The structural member H1 is a standard header or top plate while the structural member S1 is a sill, bottom plate or sole plate. Another bottom plate or sole plate (not shown) can be nailed to the bottom plate or sole plate S1 to form a conventional double bottom plate or double sole plate. A plurality of studs or joists J1 and jack studs JS1 are positioned in parallel relationship to each other and in end-to-side abutment with the plates H1, S1. Cripple studs CS1, a sill S1' and a header H1' form a window opening WO1. The studs or joists J1 can be doubled, as at J1' and, if desired, the ends of the top plate H1 and the bottom plate S1 can project from beyond the last of the studs, as indicated by the right-handmost stud J1 in FIG. 17*a*. When nailed together, the wall W1 can serve as an interior or exterior wall of a building, a partition therefor, or a horizontal floor or ceiling where the window opening WO1 could be an opening for an attic or crawl-space door. Thus, while the building structure W1 has been described using such terminology as joist, studs, plates or the like, it is to be understood that these terms are used in the general fashion, but are not limiting and the wall W1 may be employed as a vertical structural member in which case the structural elements J1 are technically "studs", whereas a horizontal structural building wall wherein the structural members J1 are technically "joist".

The building wall W2 is virtually identical to the building wall W1 and like reference characters have been applied thereto. However, in this case the opening WO2 can be a door opening in a vertical interior or exterior wall or partition or a stairway opening at the wall W2 is a floor or ceiling.

The building structures W1, W2 can be secured together by plates nailed to the projecting aligned top plates H1, H2 and bottom plates S1, S2 in a conventional manner.

The wall W3 of FIG. 17(*c*) is an example of a relatively short wall or floor section which can be formed in accordance with the present invention.

The examples of the walls W1 through W3 are not limiting and are simply exemplary of the walls or similar building structures which can be made in accordance with novel jig or fixture of the present invention which is generally designated by the reference numberal 10.

The jig or fixture 10 is designed to support the various individual structure members H1, H2, J1, J2, S1, etc. in desired assembled relationship in a generally horizontal plane through supporting means (FIG. 4), generally designated by the reference numeral 15 (FIG. 4). The supporting means or frame 15 of the jig 10 includes a first pair of supporting members or tubes 16, 17, and a second pair of supporting members or tubes 18, 19 disposed in a generally polygonal or rectangular configuration. Four identical stands or bases 25 are removably secured to the supporting tubes 16, 17, and normally support the frame 15 at a horizontal height convenient for assembling any of the walls W1 through W3.

Reference is made to FIGS. 6 and 7 of the drawings which illustrates one of the stands or bases 25 which is formed of three legs 26 through 28. The legs 26, 27 are relatively longer than the leg 28 and all three legs 26 through 28 are welded together by a weld or weldment 30 (FIG. 7) to form an upwardly opening slot or yoke 31. The slot or yoke 31 is defined by the weldment 30 and two upwardly projecting generally parallel end portions 32, 33 of the respective legs 26, 27. The upper end portion 33 (FIG. 7) of each leg 27 has a pair of diametrically opposite openings 34, 35 formed therein and a nut 36 having a thread 37 is welded within the upper end portion 33 of each of the legs 27 which are, of course, preferably tubular. A threaded bolt 38 freely passes through the openings 34, 35 and is threaded in the thread 37 of the nut 36. The supporting tube 16 (FIG. 7) rests upon the weldment 30 within the yoke or slot 31 and is removably retained in this position by the bolt 38, as is clearly evident from FIG. 7. However, in order to disassembly any one of the stands 25 from the supporting tubes 16, 17, the threaded bolt 38 is simply unthreaded and the supporting tubes 16, 17 are released from their associated slots or yokes 31.

The frame 15 of the jig 10 is maintained in its relatively rigid polygonal configuration (FIG. 4) through coupling means 40 (FIGS. 4 and 5) associated with each corner 16, 18; 17, 18; 17, 19; and 16, 19 of the frame 15. Each of the connecting means 40 includes a plug 41 (FIG. 5) having an internal thread 42. Each plug 41 is housed within and welded to the interior of the ends (unnumbered) of the tubes 16, 17. Another slidable plug or sleeve 43 is received in the ends of the tubes 16, 17, and each plug or sleeve 43 includes a radially outwardly projecting tongue 44 which is received in an axially outwardly opening slot 45 (FIG. 4) of each tube end. Each plug 43 includes an interior bore 46, a counterbore 47, and an axially outwardly directed boss 48. The boss 48 is received in an opening 50 (FIG. 5) at an end of the associated supporting tubes 18, 19 which also include diametrically opposite openings 51. A bolt 52 having a handle 53 and a threaded end portion 54 is assembled in the manner shown in FIG. 5, namely, the threaded portion 54 thereof is passed through the openings 50, 51 of the associated tubes 18, 19, the bores 46, 47 and then threaded to the threads 42. When the bolt 52 at each corner 16, 18; 17, 18; 17, 19; and 16, 19 is tightened home, the sleeve 44 is drawn into the associated end of the tubes 16, 17, as shown in FIG. 5, forming a relatively rigid connection at each of the aforesaid corners. However, when the bolt 52 is unfastened from the thread 42, the connecting means 40 at each corner can be disassembled to disassemble the tubes 16 through 19 from each other. In this fashion the supporting tubes 16 through 19 can be readily connected and disconnected from each other and can, of course, be thereby handily moved from site-to-site.

Figure 1:
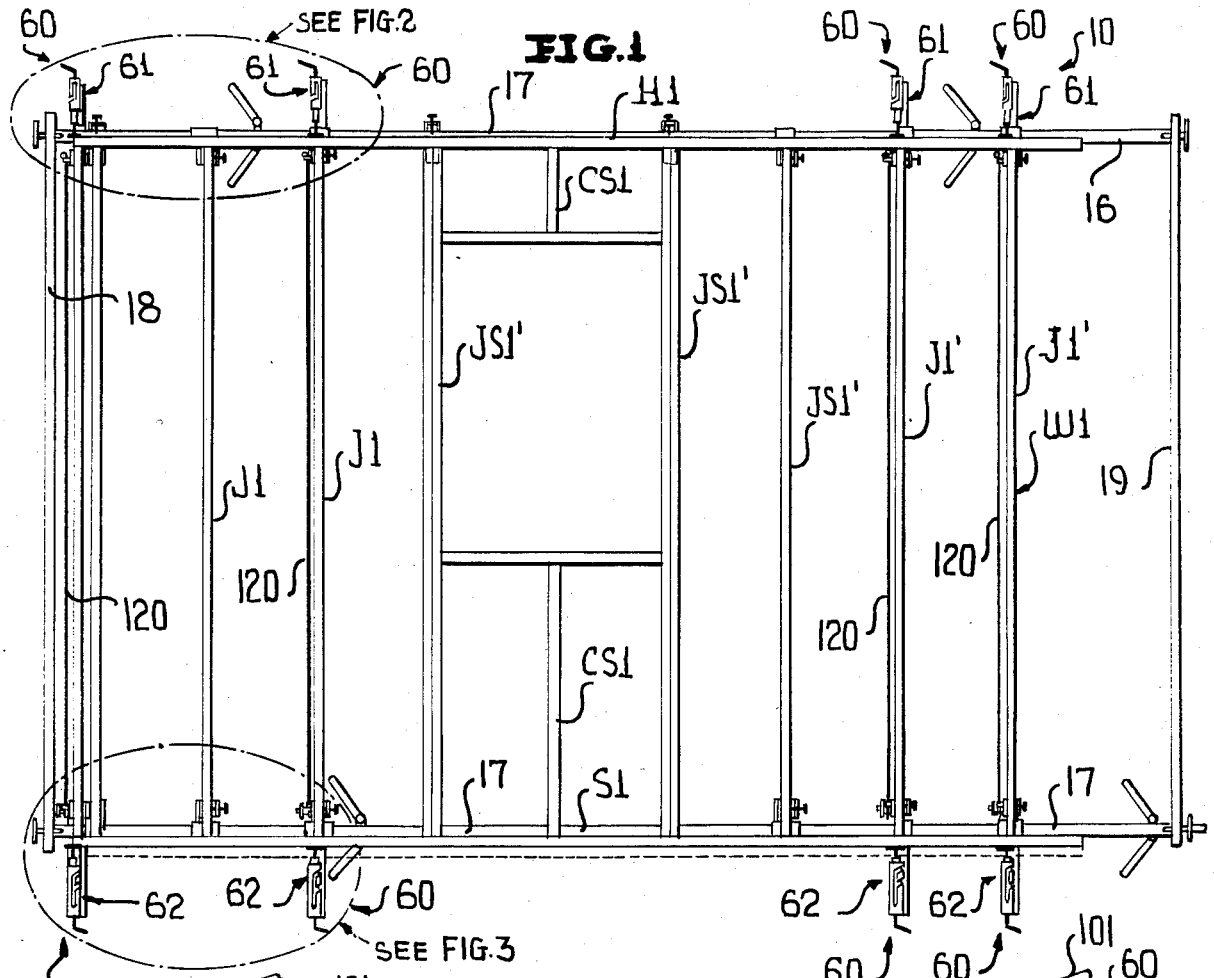

Reference is made to FIG. 1 of the drawings which illustrates four identical pairs of clamping means 60 forming part of the jig or fixture 10 with each of the clamping means 60 being defined by opposite clamping members 61, 62 disposed on opposite sides of the jig 10 in generally opposing relationship to each other. The clamping members 61 are slidably carried by the supporting tube 16, whereas the clamping members 62 are slidably carried by the supporting tube 17. The clamping members 61, 62 of the clamping means 60 are each designed to create a clamping force between the plates H1, S1 (FIG. 1) to draw the same into intimate, forceful, clamping engagement with the ends (unnumbered) of the studs or joists J1, JS1, etc., during the assembly of the wall or building structure W1.

Figure 2:
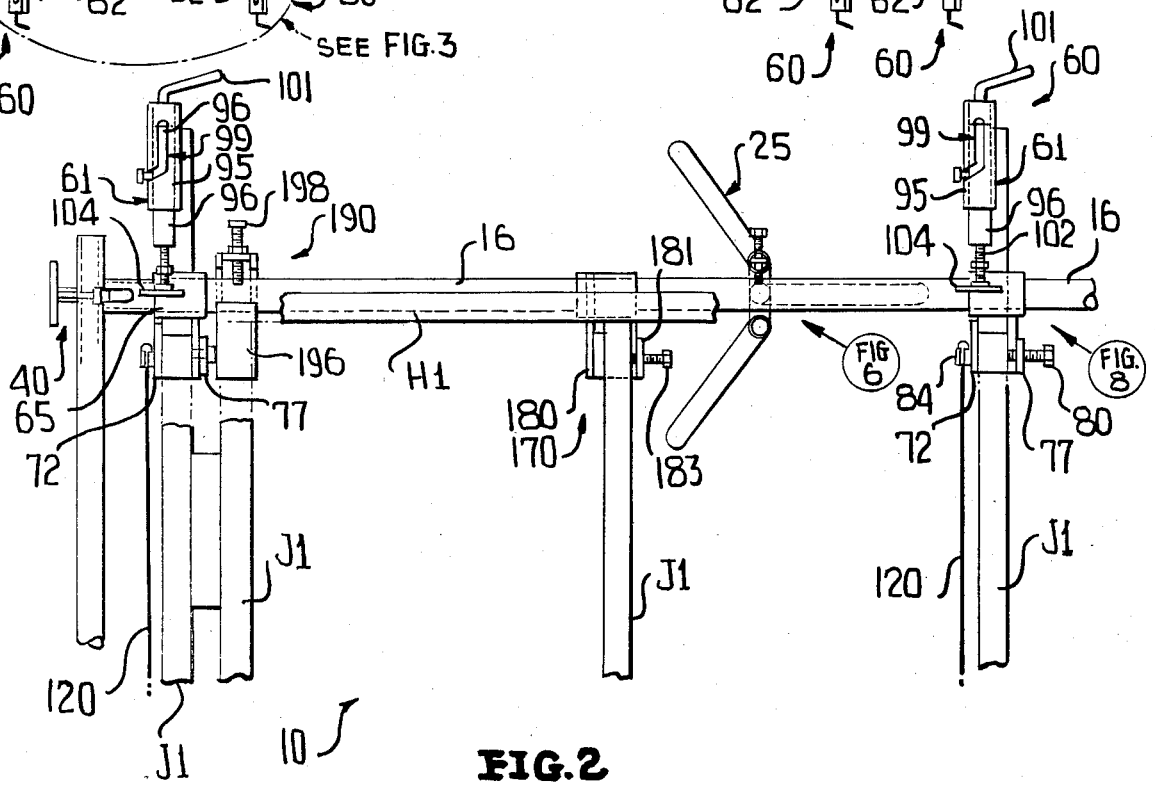
FIG. 2 is an enlarged fragmentary top plan view of the encircled portion of FIG. 1, and illustrates two clamping members of two pairs of clamping members each including a manually reciprocal rod and an associated abutment plate for bearing against the header and forcing the same and the studs toward the sole plate.
Figures 8, 9, 10, 11:
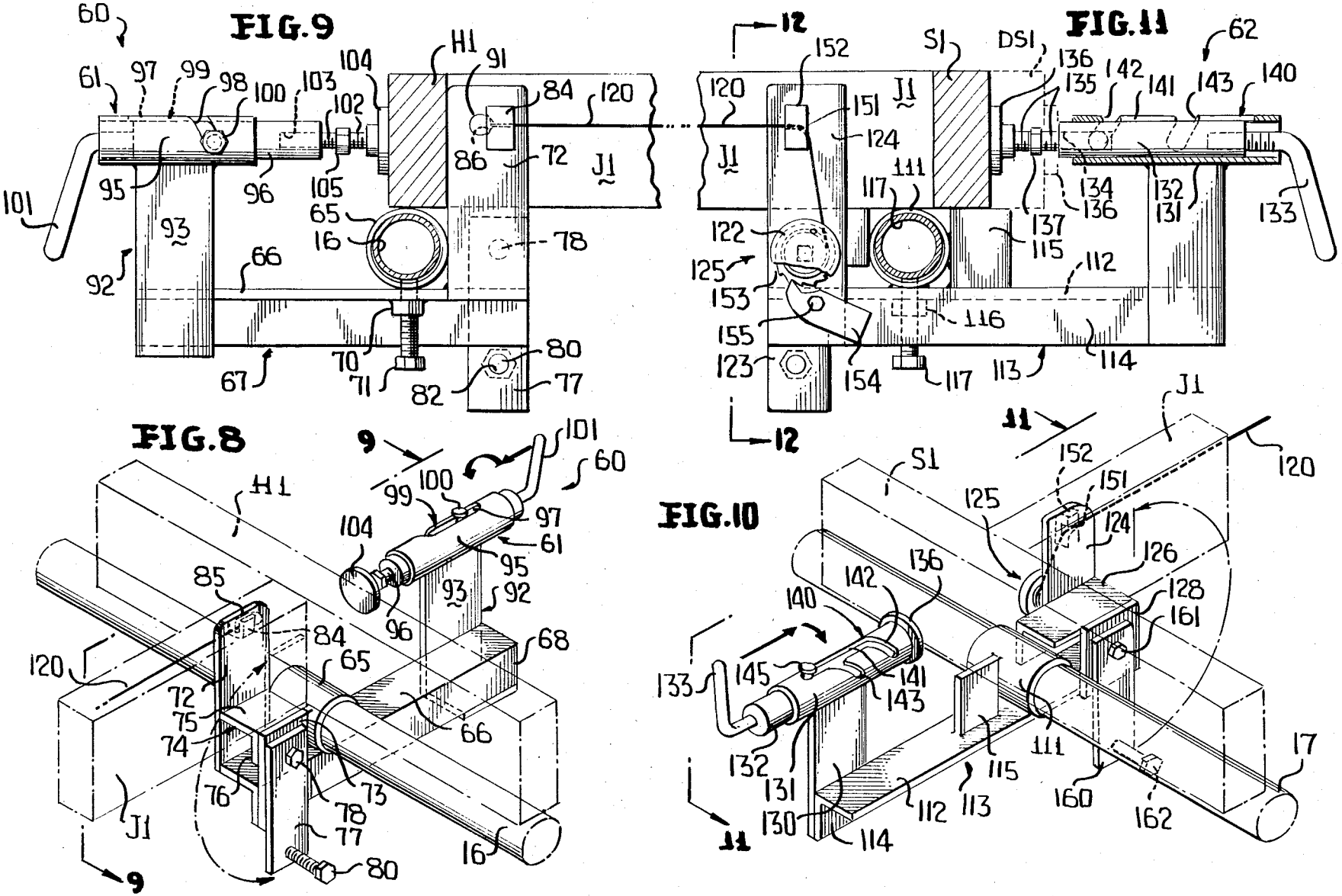
FIG. 8 is an enlarged perspective view of one of the clamping members of FIG. 2, and illustrates a manually reciprocal rod carrying an abutment plate for urging an associated header toward the opposite clamping member.
FIG. 9 is a cross-sectional view taken generally along line 9—9 of FIG. 8, and illustrates the clamped positions of the clamping member, the header supported upon a portion of the clamping member, and a tensioning cable secured to the clamping member.
FIG. 10 is a perspective view of the right-handmost clamping member of FIG. 3 which opposes the clamping member of FIGS. 8 and 9, and illustrates a manually reciprocal rod and abutment plate operative to force the sole plate or a double sole plate toward the header.
FIG. 11 is a cross-sectional view taken generally along 11—11 of FIG. 10, and illustrates an abutment plate bearing against the sole plate and a ratchet and pawl mechanism for the tensioning cable.

Reference is now made to FIGS. 2, 8 and 9 of the drawings which illustrate one of the clamping members 61 associated with the supporting tube 16 by means of a sleeve 65 which is in external telescopic sliding relationship to the supporting tube 16, as is best illustrated in FIGS. 8 and 9. The sleeve 65 is welded to a top plate 66 of an angle bar or plate 67 which has a vertical plate 68. A nut 70 (FIG. 9) is welded to the underside of the top plate 66 and a bolt 71 is threaded through the nut 70 and through openings (unnumbered) of the top plate 66 and the sleeve 65. Thus, the bolt 71 can be threaded upwardly, as viewed in FIG. 9, until the end (unnumbered) thereof abuts the underside of the supporting tube 16 to lock the sleeve 65 and, thus, the clamping member 61 anywhere longitudinally therealong. When the bolt 71 is unthreaded or released, the sleeve 65 can then be slid anywhere along the length of the supporting tube 16 or totally removed therefrom when, of course, the tubes 16 through 19 have been disassembled.

A vertical plate 72 is welded to an edge (unnumbered) of the top plate 66 and a shorter vertical plate 73 is welded to the vertical plate 68. A short angle bracket 74 includes a horizontal leg 75 welded to the vertical plate 72 and a vertical leg 76 welded to the plate 73. An arm or plate 77 is connected by a pivot pin 78 to the vertical plate 73 and carries a threaded bolt 80 which is threaded in a nut 81 (FIG. 9) welded to the arm or plate 77 in axial alignment with an opening 82 thereof. Thus, the bolt 80 can be threaded and unthreaded relative to the nut 81 and through the opening 82. When the plate 77 is swung to the vertical position shown in phantom outline in FIG. 8, the bolt 80 can be threaded through the opening 82 and against the stud or joist J1 (FIG. 8) to clamp the same tightly against the plate 72. The joist or stud J1 of FIG. 8 is, of course, in end-to-side engagement with the top plate H1 which in turn rests upon the sleeve 65 (FIGS. 8 and 9).

The vertical plate 72 also carries a relatively small U-shaped bracket 84 having an upwardly opening slot 85 (FIG. 8) and concave recesses 86 (FIG. 9) in the legs (unnumbered) of the bracket 84. The slot 85 of the bracket 84 removably receives an end portion of a flexible cable 120 of clamping or tensioning means which are generally designated by the reference numeral 125 associated with each pair of clamping members 60. The clamping or tensioning means 125 will be described more fully hereinafter, and it need be but noted that the cable 120 has fixed to its end (FIG. 9) an enlarged ball 91 which will seat in the recesses 86 of the legs (unnumbered) of the barcket 84 but can be removed therefrom, when the cable 120 is not under tension by a simple upward motion which is most apparent in FIGS. 8 and 9 of the drawings.

An L-shaped bracket 92 (FIG. 9) is welded to the bottom edge (unnumbered) of the vertical plate 68 and to the forward edge (unnumbered) of the top plate 66. A vertical plate or leg 93 of the L-shaped bracket 92 carries a tube or tubular sleeve 95 of the clamping member 61 in which is slidably reciprocally mounted a cylindrical rod 96. The sleeve 95 has a slot 99 formed by a longitudinal slot portion 97 and a transverse camming and locking slot portion 98. A headed bolt or pin 100 is guided in the slot 99 and its end is fixed to the rod 96. A handle 101 is secured to the rod 96 for reciprocating the rod 96 relative to the sleeve 95. A threaded rod 102 is threaded into a threaded bore 103 of the rod 96 and opposite thereto carries an abutment or clamping plate 104 which engages the header or top plate H1 (FIG. 9) and urges the same to the right (as viewed in FIG. 9) when the rod 96 has been shifted to the position shown in FIG. 9. The force thereby exerted against the header or top plate H1 by the clamping plate 104 can be released by simply grasping the handle 101 and retracting the rod 96 to the left with the pin or bolt 100 traveling in the slot 99. A nut 105 fixed to the shaft 102 can be rotated to thread the shaft 102 relative to the threaded bore 103 to adjust the projecting length of the theaded rod 102 relative to the rod 96 thereby accommodating for variations in the size of the 2×4's, as is prevalent in today's lumber. The plate 104 is preferably adjusted such that it bears against the plate H1 intimately and holds the same in contact with the joist or studs J1 when the bolt or pin 100 is generally at the juncture (unnumbered) of the longitudinal slot portion 97 and the transverse slot portion 98. From this point, the handle 101 is rotated to move the pin or bolt 100 along the transverse slot portion 98 which progressively moves the plate 104 forcefully to the right, as viewed in FIG. 9, creating a high clamping force and an attendant locking action as the pin 100 bottoms out at the end of the transverse clamping and locking slot portion 98 (FIG. 9).

At the opposite side of the jig 10 from the clamping members 61, there is, of course, an associated clamping member 62, as was heretofore noted, and reference is now made to FIGS. 3, 10 and 11 of the drawings.

Each clamping member 62 of the clamping means 60 includes a sleeve 111 in external sliding relationship to the tube 17. The sleeve 111 is welded to a top plate 112 of an angle iron 113 which also includes a vertical plate 114. A reinforcing plate 115 is also welded to the sleeve 111 and to the top plate 112. A threaded nut 116 is welded to the underside of the top plate 112 and receives therein a threaded bolt 117 whose end (unnumbered) passes through aligned openings (unnumbered) in the top plate 112 and the sleeve 111. When the bolt 112 is threaded upwardly, as viewed in FIG. 11, it bears against the tube 17 to lock the sleeve 111 and, thus, the clamping member 62 in any desired position of adjustment along the tube 17 in general alignment with, of course, its associated opposite clamping member 61 (See FIG. 1). When so aligned, the joist or studs J1 are supported atop the sleeves 111 (FIG. 11), while the bottom plate or sole plate S1 is supported upon an upper edge (unnumbered) of the reinforcing plate 115 (FIG. 11). The plate 115 can also support a second 2×4 (FIG.

11), when the single sole plate S1 is instead formed as a double sole plate or double bottom plate DS1 (FIG. 11). In the latter case, both 2×4's are supported by the upper edge of the reinforcing plate 115, as is illustrated in FIG. 11.

A vertical plate 130 is welded to the vertical plate 114 of the angle bracket 111 and has welded to a top thereof a tube or sleeve 131 which reciprocally mounts therein a cylindrical rod 132 carrying at one end a handle 133. The rod 132 also includes a threaded bore 134 receiving a threaded rod 135 carrying an abutment plate 136 and a nut 137. The function of the elements 134 through 137 correspond to those heretofore described to the clamping member 61. In addition, the sleeve 131 includes slot means 140 defined by a longitudinal slot portion 141 and two transverse camming and locking slot portions 142, 143. A threaded and headed bolt or pin 145 is fixed to the rod 132 and can move along the slot 140 including the slot portions 141 through 143 thereof. In order to effect the clamping action involving the clamping member 62, the handle 133 is simply grasped and the rod 132 is moved to the left (FIG. 11) to bear against the single bottom plate or sole plate S1 through the plate 136. When the handle 133 is rotated, the pin 145 moves down into the transverse slot 142 effecting a forceful forward camming and locking action, thereby bringing the bottom plate S1 against the joist J1 in a forceful manner. In the case of the double sole plate DS1, the rod 132 is moved from right-to-left, again as viewed in FIG. 11, such that the pin or bolt 145 is cammed down into the slot portion 143 to effect the clamping action of the plate 136 against the double sole plate DS1, as indicated in phantom outline in FIG. 11.

Figure 12:
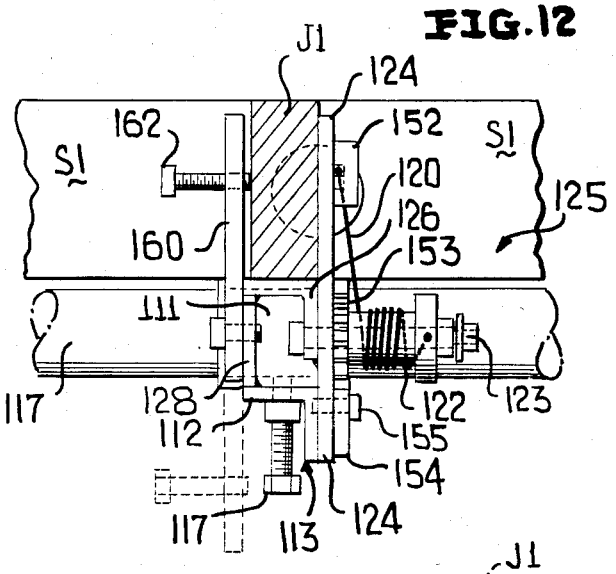
FIG. 12 is a fragmentary sectional view taken generally along line 12—12 of FIG. 11, and illustrates details of the clamping member of FIGS. 10 and 11.

In addition to the clamping of the wall W1 between the clamping member 61, 62, as is perhaps best visualized in FIGS. 9 and 11, an additional clamping or tensioning force is effected after the clamping action just described through the additional clamping or tensioning means 125 which includes in addition to the flexible cable 120 a drum or reel 122 rotatably mounted upon a pin 123 which is fixed to a vertical plate 124 (FIGS. 11 and 12). The plate 124 is welded to a short L-shaped angle bracket 126 having a leg 127 thereof welded to the bracket 113 (FIG. 10) through another vertical plate 128 welded to the top plate 112 of the bracket 113. The flexible cable 120 is guided through and about a convex slot 151 of a plate 152 which is welded to the plate 124. The cable 120 is fixed to and wound about the drum or reel 122 which also carries a ratchet 153 engaged by a pawl 154 pivoted by a pin 155 to the plate 124. The pin 123 includes a square end (unnumbered) which can be engaged by an appropriate tool, such as a conventional wrench, for rotating the reel 122 to tension the cable 120 which draws the clamping members 61, 62 toward each other against, of course, the relatively rigid connection of the frame 15. However, this tension force is simply to augment that provided by the clamping means or members 61, 62, particularly during the manual or pneumatic nailing or stapling of the 2×4's to form the wall W1. During such nailing, it is possible that absent the tension means 125, the initial tight clamping effected by the opposing clamping member 61, 62 might loosen, and though of a limited nature, this is totally avoided by the tensioning means 125.

Another pivoted plate 160 is pivoted to the plate 128 (FIG. 10) by a pivot pin 161 and carries a threaded bolt 162 which can be threaded through the plate 160 when the plate is swung to an uppermost vertical position, as is most evident in FIG. 10. In this position the bolt 162 is threaded toward the plate 124 to clamp the joist J1 (FIG. 10) thereagainst.

Referring once again to FIG. 1 of the drawings, the jig 10 has been illustrated to include four clamping means 60 each including a pair of clamping members 61, 62. However, more or less than this number may be utilized, but in cases where the number is less than the number of joist or studs J1, other means for supporting the joists or studs J1, other than the clamping members 61, 62, is also provided in accordance with the present invention, as is illustrated in FIGS. 13 and 14 and FIGS. 15 and 16 of the drawings.

Figure 13:
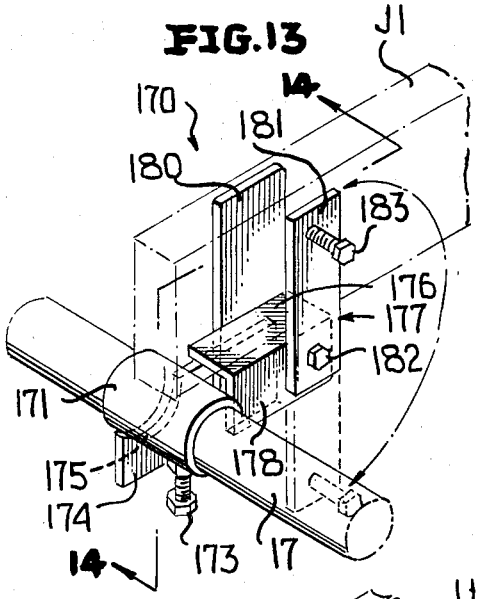
FIG. 13 is a perspective view of a stud supporting member of FIG. 3, and illustrates the manner in which a joist is supported upon a plate thereof and an arm which can be swung to embrace the stud with an associated rigid arm.
Figure 14:
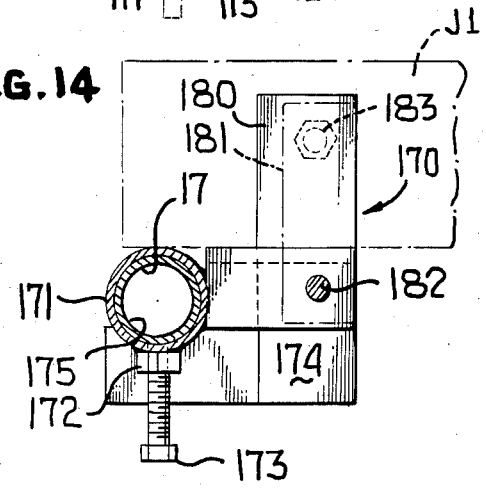
FIG. 14 is cross-sectional view taken generally along line 14—14 of FIG. 13, and illustrates a clamping mechanism for the stud support.
Figure 15:
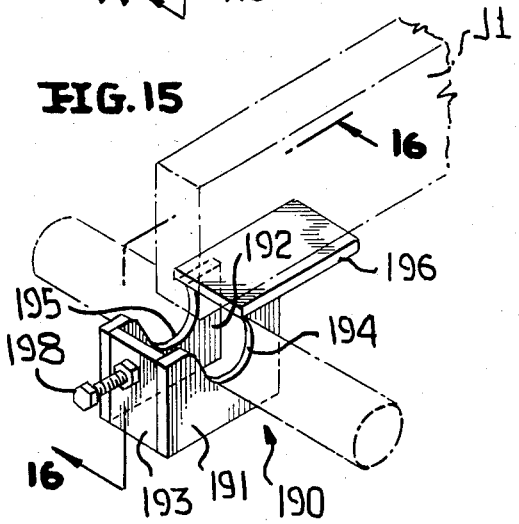
FIG. 15 is a perspective view of another stud support of FIG. 3, and illustrates a stud supported upon a plate thereof.

In FIGS. 13 and 14 of the drawings, one form of joist or stud-supporting means associated with the supporting tubes 17 is generally designated by the reference numeral 170 and includes a sleeve 171 telescopically and slidably embracing the supporting tubes 17. A nut 172 is welded to the underside of the sleeve 171 and threadably receives a threaded bolt 173. The end of the bolt 173 passes freely through an opening (unnumbered) in the sleeve 171 to bear against the tube 17, thus locking the support 170 in any desired position along the tube 17 to support a stud or joist J1 (FIGS. 13 and 14) associated therewith. A plate 174 has an arcuate cut-out 175 which is in embracing relationship to the sleeve 171. The arcuate cut-out or edge 175 is welded to the sleeve 171, as is a top plate 176 of an angle bracket 177 which includes a vertical plate 178. A vertical plate 180 is welded to the edge of the plate 176 and to the plate 174, while another plate 181 is pivotally connected by a pivot pin 182 to the vertical plate 178. The plate 181 carries a threaded bolt 183 which can be threaded toward the vertical plate 180 when the plate 181 is in its upright vertical position (solid outline in FIG. 13) to rigidly clamp the joist or stud J1 between the bolt 183 and the plate 180.

Figure 16:
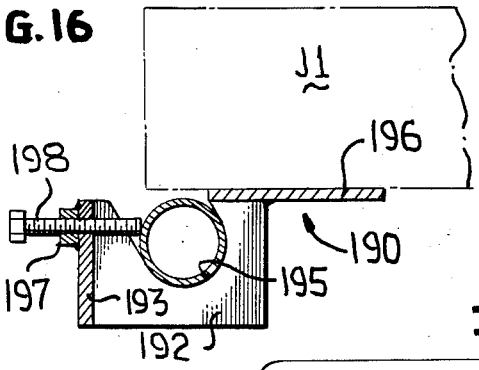
FIG. 16 is an enlarged fragmentary sectional view taken generally along line 16—16 of FIG. 15, and illustrates the manner in which a threaded bolt secures the stud support to an associated supporting tube.

In those cases where it is unnecessary to clamp the stud or joist J1 and supporting the same is sufficient, another joist or stud support 190 (FIGS. 15 and 16) is provided and includes a generally U-shaped bracket defined by legs 191, 192, a bight 193 and arcuate notches or slots 194, 195 and the respective legs 191, 192 for receiving any one of the longitudinal tubes 16, 17. A horizontal plate 196 is welded atop the legs 191, 192 to support one of the joist J1 thereupon, as is readily apparent in FIGS. 15 and 16. A threaded nut 197 is welded to the bight 193 and threadedly receives a threaded bolt 198 which can bear against the supporting tube, as is best shown in FIG. 16, for locking the joist or studs supporting bracket 190 relative to any of the tubes 16, 17 along the length thereof.

From the foregoing, it is believed readily apparent that once the frame 15 (FIG. 4) has been assembled and supported upon the bases 25, the worker/carpenter need but position along the tube 16, 17 as many of the clamping members 61, 62 as might be needed, together with any number of the joist or stud supporting means 170, 190. These are simply positioned at approximate positions along the desired centerline distances between the joists or studs J1. Once this is accomplished, the header H1, sole plate S1, studs J1, etc. are positioned and supported in the manner clearly evident from FIGS. 1 through 3 of the drawings in particular. The rods 96, 132 of the clamping members 61, 62, respectively, are, of course, at this time retracted to facilitate the positioning of the 2×4's upon the frame 15, and thereafter all of the handles 101 of the clamping member 61 are moved to their locked position (FIG. 9) followed by the movement of the rods 132 to their locked position. If two workers are involved, each can move an associated one of the rods 96, 132 through their respective handles 101, 133 simultaneously toward each other to achieve the clamping action effected by the plates 104, 136 thereof. It is not particularly important as to how or when the clamping members 61, 62 are moved to their clamping position, merely that this be done in a uniform manner so as to maintain the relatively "square" or plumb desired final position of the wall W1. Once all of the clamping members 61, 62 have been clamped it is then necessary to simply "snug-up" the same by tensioning the associated cables 120 thereof through the clamping or tensioning means 125 heretofore described by rotating the drum or reel 122. Once this has been done, the 2×4's are simply nailed together manually or pneumatically and thereafter the tensioning and clamping forces are relieved and the completed wall W1 can be removed from the jig 10.

Although a preferred embodiment of the invention has been specifically illustrated and described herein, it is to be understood that minor variations may be made in the apparatus without departing from the spirit and scope of the invention, as defined in the appended claim.

We claim:

1. A jig for assembling a prefabricated building wall or similar structure comprising means for supporting a plurality of first structural members in generally spaced parallel relationship to each other and at least one second structural member therewithin, generally normal to and in end-to-side engaging relationship to the first structural members; said supporting means including a relatively rigid frame including first and second spaced elongated generally parallel supporting members adjacent each of which is adapted to be supported one of the first structural members, means for forcing the first structural memebers toward each other to thereby tightly clamp the second structural member therebetween, said forcing means including first and second relatively spaced, opposing and aligned clamping members carried by said respective first and second supporting members with each being adapted to abuttingly engage an associated one of the first structural members; said clamping members normally setting-off therebetween a first clamping distance corresponding to the external distance between the first and second structural members, means for step-wise adjustably increasing the first distance to a second distance corresponding to the total of the first distance and the thickness of one of the first structural members, said step-wise adjusting means being defined by a rod of said first clamping member mounted for sliding movement between first and second clamping positions toward and away from said second clamping member by a fixed incremental distance corresponding to the thickness of the one of the first structural members thereby defining with the second clamping member said first and second distances, means for locking said rod at each of said first and second positions, said forcing means further including a flexible cable connected between said first and second clamping members, and means for tensioning said flexible cable to draw said clamping members into intimate tight clamping engagement with the first structural members in both the first and second clamping positions thereof.

2. the jig as defined in claim 1 wherein said tensioning means includes a drum upon which said flexible cable can be wound to draw said clamping members into intimate tight clamping engagement with the first structural members in both the first and second clamping positions thereof.

3. The jig as defined in claim 1 including means for mounting said first and second clamping members for reciprocal sliding movement along the respective first and second supporting members.

4. The jig as defined in claim 3 wherein at least one of said clamping members includes means for at least temporarily attaching an end of the second structural member to said last-mentioned clamping member.

5. The jig as defined in claim 3 wherein at least one of said clamping members includes means for laterally engaging and aligning an end of the second structural member relative to the last-mentioned clamping member.

6. The jig as defined in claim 3 wherein at least one of said clamping members includes means for laterally engaging and aligning an end of the second structural member relative to the last-mentioned clamping member, and said engaging and aligning means is an upstanding plate.

7. The jig as defined in claim 3 wherein at least one of said clamping members includes means for laterally engaging and aligning an end of the second structural member relative to the last-mentioned clamping member, said engaging and aligning means is an upstanding plate, and means for swinging said plate between an operative upright position and an inoperative position.

8. The jig as defined in claim 3 wherein said reciprocal sliding mounting means includes an arcuate surface.

9. The jig as defined in claim 3 wherein said reciprocal sliding mounting means is a sleeve.

10. The jig as defined in claim 1 wherein said frame includes a pair of generally parallel stabilizing members spanning the distance between said first and second supporting members at ends of the latter, and means for removably securing said stabilizing members to said first and second supporting members to thereby permit rapid knockdown and reassembly of said frame.

11. The jig as defined in claim 1 including means for threadably adjusting each clamping member to obtain additional fine adjustment of said clamping members and the first and second distances obtained thereby.

12. The jig as defined in claim 1 wherein said locking means includes a cam.

13. The jig as defined in claim 1 wherein each said locking means includes an elongated slot and two transverse slot portions associated therewith, and each rod includes a pin movable along said slot and slot portions.

14. The jig as defined in claim 1 wherein at least one of said clamping members includes a generally flat horizontal plate for supporting an end of said second structural member.

15. The jig as defined in claim 1 wherein at least one of said clamping members includes means for underlyingly supporting an end of said second structural member and means for laterally engaging and aligning an end of said second structural member.

16. The jig as defined in claim 1 wherein at least one of said clamping members includes means for underlyingly supporting an end of said second structural member, means for laterally engaging and aligning an end of said second structural member, and said underlyingly supporting means and laterally engaging and aligning means are surfaces having planes disposed generally normal to each other.

17. The jig as defined in claim 1 wherein at least one of said clamping members includes means for at least temporarily attaching an end of the second structural member to said last-mentioned clamping member.

18. The jig as defined in claim 1 wherein at least one of said clamping members includes means for laterally engaging and aligning an end of the second structural member relative to the last-mentioned clamping member.

19. The jig as defined in claim 1 wherein at least one of said clamping members includes means for laterally engaging and aligning an end of the second structural member relative to the last-mentioned clamping member, and said engaging and aligning means is an upstanding plate.

20. The jig as defined in claim 1 wherein at least one of said clamping members includes means for laterally engaging and aligning an end of the second structural member relative to the last-mentioned clamping member, said engaging and aligning means is an upstanding plate, and means for swinging said plate between an operative upright position and an inoperative position.

* * * * *